US008256356B2

(12) United States Patent
Fremming

(10) Patent No.: US 8,256,356 B2
(45) Date of Patent: Sep. 4, 2012

(54) DISPLAY TABLE AND CONVEYING DEVICE FOR A CREMATION URN

(76) Inventor: David Fremming, Ankeny, IA (US)

( * ) Notice: Subject to any disclaimer, the term of this patent is extended or adjusted under 35 U.S.C. 154(b) by 675 days.

(21) Appl. No.: 12/354,959

(22) Filed: Jan. 16, 2009

(65) Prior Publication Data

US 2009/0178594 A1 Jul. 16, 2009

Related U.S. Application Data

(60) Provisional application No. 61/021,492, filed on Jan. 16, 2008.

(51) Int. Cl.
*A47B 37/00* (2006.01)

(52) U.S. Cl. ..... 108/50.02; 108/90; 108/139

(58) Field of Classification Search ..... 108/90, 108/139, 147.19, 147.21, 25, 26, 50.02, 50.11; 296/16, 18; 211/85.27
See application file for complete search history.

(56) References Cited

U.S. PATENT DOCUMENTS 2,206,762 A * 7/1940 Breeden ..... 296/18
2,229,320 A * 1/1941 Balzano et al. ..... 108/75
2,460,712 A * 2/1949 Peterson ..... 297/174 R
2,680,660 A * 6/1954 Stephens ..... 108/94
3,572,562 A * 3/1971 Floyd, Jr. ..... 224/275
4,500,150 A * 2/1985 Leibensperger et al. ..... 439/502
D304,641 S * 11/1989 Bourassa ..... D99/5
5,664,714 A * 9/1997 Navarro et al. ..... 224/275
6,154,956 A * 12/2000 Frohardt ..... 29/825
6,254,152 B1 * 7/2001 Tillett ..... 294/15
6,439,133 B1 * 8/2002 Jaramillo ..... 108/25
6,648,430 B2 * 11/2003 Rohde et al. ..... 312/301
7,621,575 B1 * 11/2009 Kellerman ..... 296/16

OTHER PUBLICATIONS

Kates-Boylson; Urn Carriers Enhance Cremation Options and Utilization of Hearses; Kates-Boylson White Papers; Oct. 1, 2007; pp. 1-12; Copyright 2008 Kates-Boylston Publications.
Aurora Casket Company; The Reposium—A Respectfully Elegant Option for Cremation Services; Oct. 14, 2007; p. 1 of 1; Copyright 2005 by Aurora Casket Company, Inc.
Aurora Casket Company; Reposium With Urn and Flowers; Oct. 14, 2007; p. 1 of 1; Copyright 2005 by Aurora Casket Company, Inc.
Heavenly Wood; 407C Urn Altar; Oct. 10, 2007; p. 1 of 1; Copyright 2006 Heavenly Wood.
Accubuilt; The Commemorative Carriage Serve Your Families With Greater Respect . . . Increase the Content of Your Services; Oct. 10, 2007; p. 1 of 1.
North Urn Ltd.; The Future of Cremation Services; Oct. 10, 2007; p. 1 of 1; North Urn Ltd.
Charleston; Cremation Supplies; Oct. 14, 2007; p. 1 of 1; Copyright 2007 Charleston Trigard.
LJ Enterprises; The Legacy Set; Feb. 22, 2007; p. 1 of 1; L J Enterprises, Lawrenceville, GA 30044-3856.
Zornex; Your Replica Cremation Monument Urn w/ Mobile Altar; Oct. 10, 2007; pp. 1-5.

* cited by examiner

*Primary Examiner* — Hanh V Tran
*Assistant Examiner* — Andres F Gallego
(74) *Attorney, Agent, or Firm* — Zarley Law Firm, P.L.C.

(57) ABSTRACT

A display table assembly for displaying an urn. The display table has a plurality of retractable legs and a table top. Swivably connected to the table top is an urn carriage so that the urn carriage may be rotated for display. The urn carriage has first, second, front, and back sidewalls that enclose an open interior that is of size and shape to receive an urn chest.

11 Claims, 3 Drawing Sheets

DISPLAY TABLE AND CONVEYING DEVICE FOR A CREMATION URN

CROSS REFERENCE TO RELATED APPLICATION

This application claims the benefit of U.S. Provisional Application No. 61/021,492 filed Jan. 16, 2008.

BACKGROUND OF THE INVENTION

This invention relates to funeral accessories. More specifically, this invention relates to a table used in association with displaying and transportation of an urn.

Funeral services and ceremonies have changed dramatically in the past few decades. Empowered with increased knowledge of costs and options families seeking after death services are looking beyond those of traditional funeral homes and are making plans with cremation societies, cemeteries and church organizations. As a result an increasing number of individuals are choosing cremation as a preferred manner of honoring a loved one. Specifically, cremation oftentimes is the most financial viable manner of honoring a loved one after their death.

Traditional funeral homes already have the facilities and training to conduct memorial services and disposition ceremonies. By offering a practice tailored to those selecting cremation for the remains, funeral directors can provide the connection between the traditional funeral services and growing number of people making non traditional choices.

As a result in the increase in cremations a need in the art exists for supplies and accessories associated with cremation in order to enhance a loved ones experience during the cremation ceremony. Several of those in the art have attempted to address this growing demand for cremation accessories by providing a multitude of different cremation tables, stands and the like that contain an urn or a remembrance box for display. Additionally, tables have been provided with additional means that allow memorabilia associated with the loved one to be placed on display.

While the tables described provide accessories for the cremation ceremony, problems still exist. For example, only a minimal amount of space is provided for displaying the loved ones memorabilia. Another problem associated with display tables is that they are difficult to move and specifically the carriage holding the urn oftentimes is difficult for a pallbearer to gain access to in order to take the urn to a final resting place. Other problems exist with holding pieces of the table in place and transporting the urn. Specifically, carriages for urns are smaller than traditional caskets meaning current funeral equipment is inadequate for containing and transporting the carriages.

Therefore, an objective of the present invention is to provide a device that provides greater space for displaying a memorabilia.

Another objective of the present invention is to provide a device that is more accessible for pallbearers.

A still further objective of the present invention is to provide a device that is easier to transport from a ceremony to the graveyard.

These and other objectives will be apparent to one skilled in the art based upon the following disclosure.

BRIEF SUMMARY OF THE INVENTION

A display assembly includes a display table that has a plurality of legs, a table top, and a plurality of removable extensions. Placed upon the display table is an urn carriage that is set upon a swivel base that is either connected to or placed upon the table top. The urn carriage has first, second, front, and back sidewalls that enclose an open interior that is of size and shape to receive an urn chest.

Also provided is a catafalque assembly for receiving the urn carriage during transportation. The catafalque assembly has a base member with a top that is slidably connected to the base member and has a bracing member and a groove disposed therein. A stabilizing member fits slidably within the groove so that an urn carriage is held between the bracing member of the top and the stabilizing member.

DESCRIPTION OF THE PREFERRED EMBODIMENT

Figure 1:
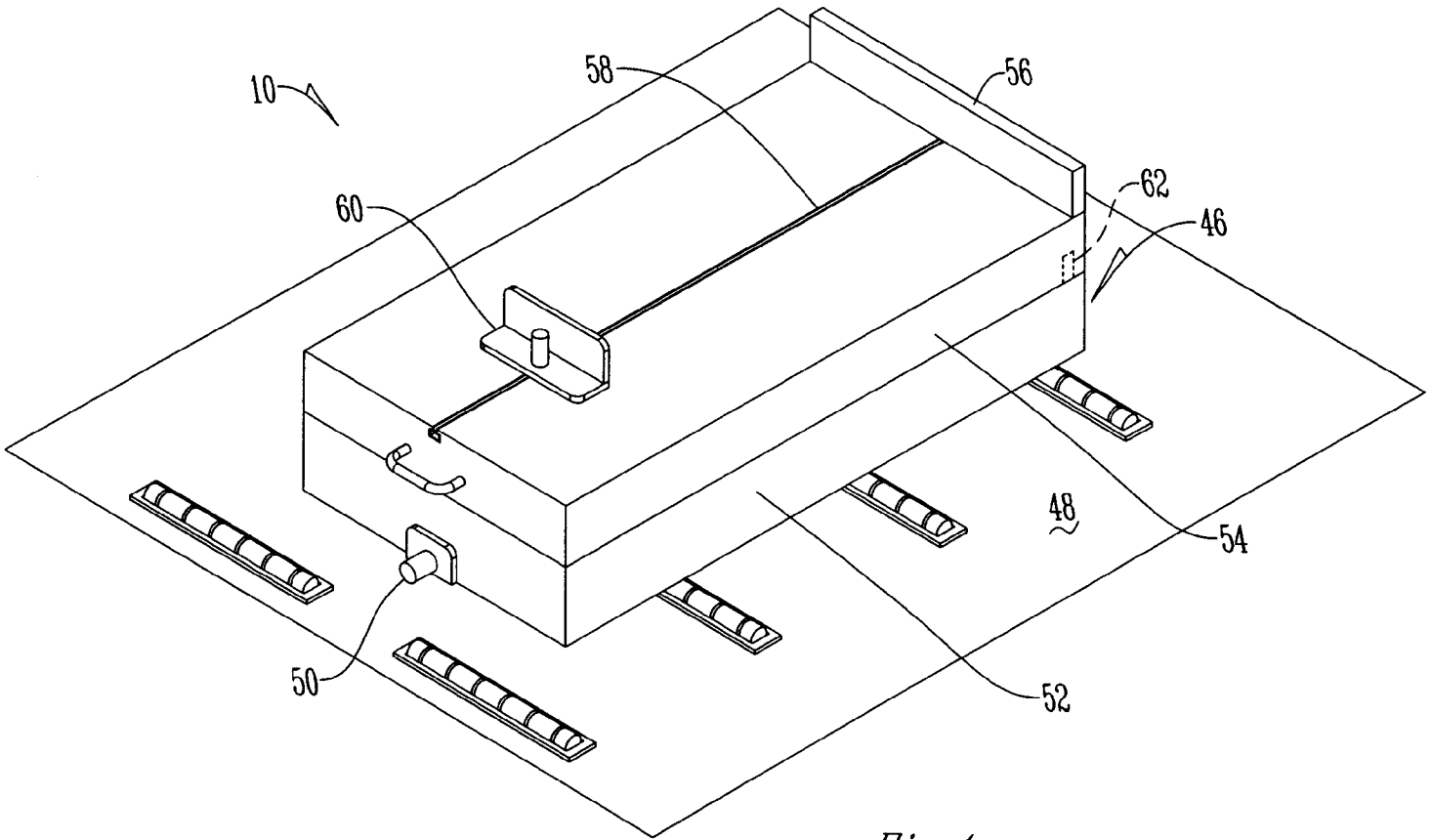
FIG. 1 is a perspective view of a display table.
Figure 2:
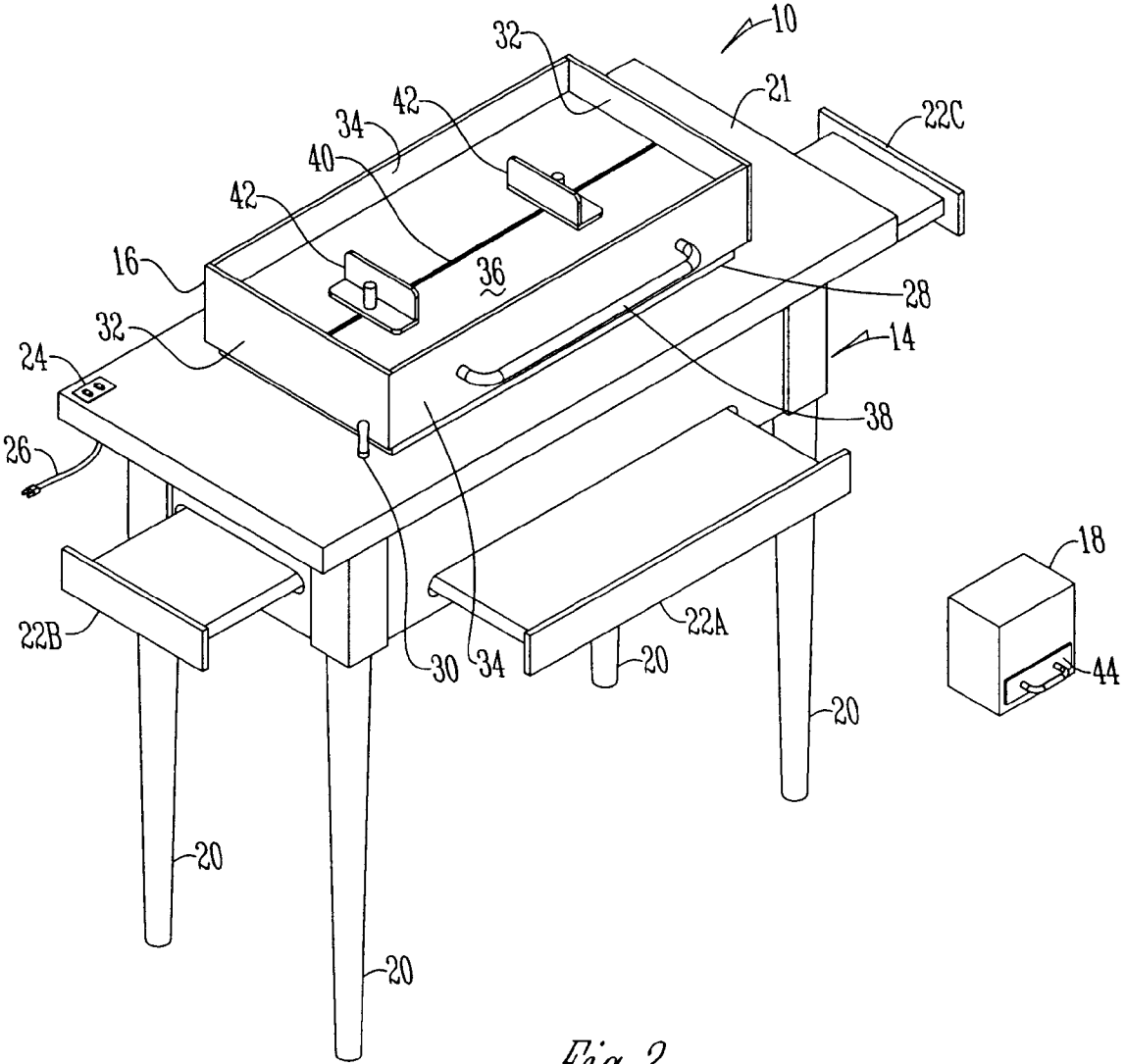
FIG. 2 is a perspective view of a catafalque.
Figure 3:
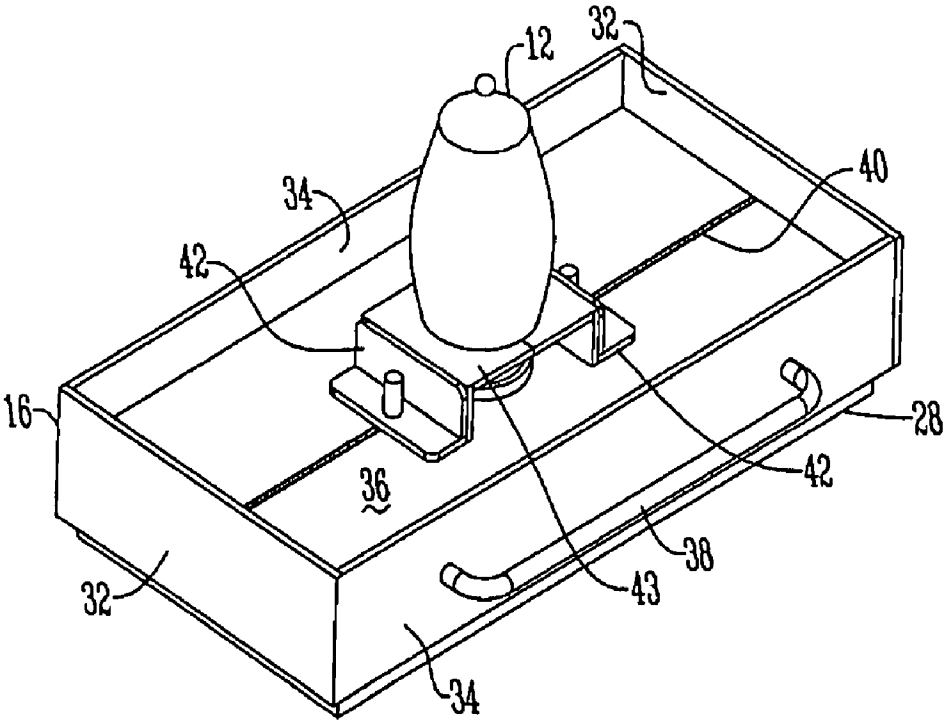
FIG. 3 is a perspective view of an urn carriage.

The figures show a cremation assembly 10 used to display and transport an urn 12. The cremation assembly 10 includes a display table 14 having an urn carriage 16 disposed thereon wherein the urn carriage 16 holds an urn chest 18 such as a keepsake box used to house the urn. In a preferred embodiment the display table 14 is considered a remembrance table for honoring life.

The display table 14 is similar to a conventional table in that it has a plurality of legs 20 that support a table top. While shown with a plurality of legs 20, a single post or multiple posts could be used without falling outside the scope of this disclosure. Also, in one embodiment the legs 20 are extendible and may be adjustable for uneven surfaces particularly at a graveyard. The display table 14 itself has a plurality of extensions 22. In the front of the display table a front extension 22A extends from one leg 20 to another such that the width of the front extension 22A is wider than the urn carriage 16. The front extension 22A slidably is pulled out of the interior of the table by such means as slide in rails or the like. Specifically, the extension 22A pulls out and has the depth of the entire table 14. Therefore, by having the front extension 22A with a width greater than the urn carriage 16 and a depth equal to the depth of the table itself, a maximum amount of room is provided for displaying items.

The display table 14 additionally has first and second side extensions 22B and 22C. The first and second side extensions 22B and 22C, similar to the front extension, are disposed within the display table 14 and slidably move away from the interior of the table similar to a drawer. For example, a slide in rail combination could be used as is known in the art in order to pull out the extensions. The first and second side extensions 22B and 22C are located in spaced relation above the front extension 22A and on a common plane with one another. Thus, the first and second side extensions 22B and 22C can be used to hold additional memorabilia or items that are to be displayed. The extensions are removable if desired.

The table top 21 itself is designed to accommodate a rug or padding member placed thereon for use in association with the urn carriage 16. The table top additionally can have a section carved specifically for receiving a lamp that provides additional illumination for enhanced displaying of a loved ones memorabilia. At least one outlet 24 is secured to the table 14. The outlet 24 is connected to at least one wire that extends through a conduit underneath the top surface of the table 14.

The wire is connected to a power cord 26 that extends to a source of power. The power cord 26 preferably is retractably attached to the table 24.

The urn carriage 16 is swivably placed on top of the display table. Specifically, the urn carriage has a swivel base 28 such that the urn carriage 16 may be rotated as needed. Thus, a funeral director may swivel the urn carriage 16 to a desired location for enhanced display. Alternatively, pallbearers may similarly swivel the urn carriage 16 for improved access to the carriage 16. When a non-swivel urn carriage is presented on the display table, the table top can be designed with a center section that includes a built-in swivel 28. Alternatively a stand-alone swivel base 28 can be placed between a non-swivel urn carriage 16 and the display table top. Thus any embodiment wherein the urn carriage swivels relative to the display table is contemplated by this disclosure. Stops 30, such as a pull-ring device are mounted in the table top and positioned to engage the carriage 16 and prevent rotation when in an up position.

The urn carriage 16 additionally has first and second side walls 32 connected to front and back side walls 34 to enclose a hollow open interior 36 not having a top. U-shaped rails 38 are secured to the front and back walls 34 to provide handles for pallbearers to carry the urn carriage. Within the interior 36 of the urn carriage 16 is a fanciful padding material that is aesthetically pleasing to a viewer. A centrally located groove 40 extends from the first side wall to the second side wall 32 and extends the width of the urn carriage 16. Thus, stabilizing members 42 may slide within the grooves 40 and be tightened to the carriage. In a preferred embodiment the stabilizing members 42 are L-shaped book ends, or brackets, used to engage either side of the urn chest 18 to hold the urn chest 18 in place. Alternatively, when a cylindrical cremation urn 12 is placed in the carriage a second L-shaped book end, or bracket 43, having a curved face is affixed to stationary first L-shaped bracket with a concealed rare earth magnet thus stabilizing the urn during transportation. Also, the stabilizing member 42 is a high strength reclosable fastener such as hook and loop material attached to the interior 38 of the carriage 16 adjacent groove 40. A corresponding reclosable fastener is applied to the bottom of the urn 12. This provides for additional and concealed stabilization of the urn during transport.

The urn chest 18 is of any size and shape to house an urn 12 and preferably has a keepsake drawer 44 therein. Specifically, the keepsake drawer 44 can be pulled out of the chest 18 as is known in the art and contains special items of the deceased.

To assist in the transportation of the urn carriage 16 an improved catafalque 46 is also contemplated. Specifically, the catafalque 46 is anchored into a coach 48 or hearse with stabilizing pins 50 on either end. The catafalque 46 has a base member 52 and a slidable top 54. Specifically, the top 54 is connected to and slides off of the base 52 such that the top 54 may be pulled out of the coach 48 or hearse while leaving the base member 52 therein. Thus, the top 54 may be drawn back such that the carriage 16 can be placed on the top 54 and rest against a bracing member 56 of the top. The top 54 additionally has a centrally located groove 58 that extends the length of the top 54 such that a stabilizing member 60 may be slidably placed in the groove 58 and secured therein to hold against the urn carriage 16. Again, preferably, as with the urn carriage 16 the stabilizing member 60 is an L-shaped book end. The top member 54 may then be slid back onto the base 52 such that the stabilizing member 60 can be secured therein to hold the urn carriage 16 in place. The top 54 is held in place via a detent 62 such that the top does not slide off the base during driving of the coach 48 or hearse. However, a person has the strength to force the top out of the detent 62 position in order to access the top 54 to place the urn carriage 16 thereon.

In operation, when an urn 12 is to be displayed the urn 12 is placed within the urn chest 18 and into the urn carriage 16. The stabilizing members 42 of the urn carriage 16 are then placed on either side of the urn chest 18 and secured within the urn carriage 16 to hold the urn chest 18 in place. The first and second side extensions 22B and 22C and front extension 22A are then pulled out of the table such that memorabilia may be placed thereon. For enhanced visual display the urn carriage 16 may be positioned upon its swivel base 28 to a proper location.

After the displaying ceremony is complete the memorabilia can be removed from the first and second side extensions 22B and 22C and front extension 22A and the extensions may be retracted back into the display table 14. The urn carriage 16 then swivels on its base 28 to an appropriate and best position such that pallbearers can grab the rails 38 of the urn carriage 16 to transport the carriage 16 to the funeral coach 48. At this time the top 54 of the catafalque 46 is extended and the carriage 16 is slid onto the top 54 surface against the bracing member 56. A stabilizing member 60 is placed on the opposite side of the urn carriage 16 to hold the carriage 16 in place and the top 54 of the catafalque 46 is retracted back to its original detent position.

Thus, provided is an urn display table, carriage and catafalque that improve upon the state of the art. Specifically, the amount of display area for memorabilia is increased over other tables in the art by using a plurality of extensions that extend the width and depth of the table. Additionally, by having a swivel base on the carriage urn enhanced display and transporting features are presented. Further, the stabilizing members used in association with the urn carriage and urn chest provide additional securement to improve upon the state of the art. Finally, disclosed is an improved catafalque with a retractable top used in order to facilitate the transportation of the urn carriage. Thus, at the very least all of the stated problems have been addressed.

What is claimed is:

1. A display and conveying device, comprising:

a display table having a plurality of legs and a table top;

a swivel base placed upon the table top;

an urn carriage having a single, continuous groove disposed within a hollow open interior of the urn carriage wherein the groove extends the width of the urn carriage from a first sidewall of the urn carriage to a second sidewall of the urn carriage; and stabilizing members to receive and secure an urn or an urn chest.

2. The device of claim 1 wherein the urn carriage has front and back sidewalls and a pair of rails secured to the front and back sidewalls.

3. The device of claim 2 further comprising at least one of said stabilizing members slidably mounted within the groove.

4. The device of claim 3 wherein at least one of said stabilizing members is L-shaped.

5. The device of claim 1 wherein the swivel base is connected to the table top.

6. The device of claim 1 wherein the display table has an electrical outlet therein with a power cord.

7. The device of claim 1 wherein the display table has at least one slidable extension.

8. The device of claim 1 additionally comprising one or more stops mounted within the table top of the display table and positioned to engage and prevent rotation of the urn carriage when the one or more stops are in an upward-extending position.

9. The device of claim 1 wherein the display table includes a front extension having a width greater than a width of the urn carriage wherein the front extension slidably extends from a front of the display table from an interior of the display table.

10. The device of claim 1 wherein the stabilizing members include first and second L-shaped stabilizing members wherein the first and second L-shaped stabilizing members are slidable within the groove on either side of the urn or urn chest.

11. The device of claim 10 additionally comprising a bracket with a magnet secured between the first and second L-shaped stabilizing members.

* * * * *